United States Patent [19]

Sakamoto et al.

[11] Patent Number: 4,721,484

[45] Date of Patent: Jan. 26, 1988

[54] INTEGRATED CIRCUIT PACKAGE WITH TERMINALS HAVING RECEPTACLES WITH ELASTIC CONTACTS

[75] Inventors: Haruo Sakamoto, Tokyo; Fumihisa Kawai, Kawasaki, both of Japan

[73] Assignee: E. I. Du Pont de Nemours and Company, Wilmington, Del.

[21] Appl. No.: 3,234

[22] Filed: Jan. 14, 1987

[30] Foreign Application Priority Data

Jan. 29, 1986 [JP] Japan ..... 61-11500[U]

[51] Int. Cl.[4] ..... H01R 13/11

[52] U.S. Cl. ..... 439/842

[58] Field of Search ..... 339/256 R, 256 SP, 258 R, 339/258 F, 258 P, 258 S

[56] References Cited

U.S. PATENT DOCUMENTS

| | | | |
|---|---|---|---|
| 3,047,832 | 7/1962 | Deakin | 339/217 |
| 3,362,008 | 1/1968 | Berg | 339/258 |
| 3,370,265 | 2/1968 | Berg | 339/256 |
| 3,425,030 | 1/1969 | Hadden | 339/256 SP |
| 3,538,491 | 11/1970 | Longenecker et al. | 339/256 |
| 3,663,931 | 5/1972 | Brown | 339/218 |
| 3,717,841 | 2/1973 | Mancini | 339/258 |
| 3,992,076 | 11/1976 | Gluntz | 339/258 |
| 3,997,237 | 12/1976 | White | 339/275 |
| 4,445,747 | 5/1984 | Neidich | 339/256 |
| 4,480,386 | 11/1984 | Adams | 29/874 |
| 4,545,638 | 10/1985 | Neidich | 339/205 |
| 4,560,231 | 12/1985 | Shirai | 339/256 R |

FOREIGN PATENT DOCUMENTS

| | | | |
|---|---|---|---|
| 0123383 | 10/1984 | European Pat. Off. | 339/256 R |

*Primary Examiner*—Joseph H. McGlynn

[57] ABSTRACT

A connector device comprises a plug pin and a receptacle for receiving the plug pin therein. The receptacle is bent into a substantially rectangular parallelepiped configuration such that a pair of parallel elastic contact sections are formed at one side of a pair of opposite sides of the rectangular parallelepiped. The plug pin is also of a substantially rectangular configuration in cross section to permit it to be elastically sandwiched between the aforementioned opposite sides of the receptacle. The plug pin is so formed as to have arcuate side edges at its side face which is contacted by the pair of elastic contact sections.

7 Claims, 10 Drawing Figures

INTEGRATED CIRCUIT PACKAGE WITH TERMINALS HAVING RECEPTACLES WITH ELASTIC CONTACTS

BACKGROUND OF THE INVENTION

This invention relates to a connector device having a plug pin and receptacle for receiving the plug pin to provide the electrical connection between the plug pin and the receptacle, and in particular to a connector device having a very small plug pin and very small receptacle for receiving the pin and adapted for use in making an electrical connection on a flat plate-like IC package.

FIG. 1 shows one form of a flat plate-like IC package 70 comprised of a body for receiving semiconductor integrated circuits, such as a memory and CPU, and connector 72 having a greater number of holes 73 in a grid-like array with each receptacle 74 located within the corresponding hole. The holes are densely formed such that, for example, 10 holes are located across the end face, 1 cm in length, of the connector. From this it will be appreciated that the respective terminals are very small in dimension.

FIG. 2 shows receptacle 74 with a plug pin detached. Receptacle 74 is comprised of cylindrical contact section 75 and external connection pin 76 extending from one end of contact section 75. The semiconductor device of IC package 70 is connected to forward end **76*a* of external connection pin 76. One end 78*a* of plug pin 78 is inserted into cylindrical contact section 75. Plug pins 78 are inserted into connector 79 as shown in FIG. 3 in which case the other end 78*b* of plug pin 78** is connected to, for example, a circuit of a printed circuit board. In this way, the semiconductor circuit of the IC package is connected to that of the aforementioned printed circuit board.

In connector device including connectors 72 and 79, plug pin 78 is a round bar, i.e., a bar circular in cross-section. As shown in FIG. 4, the diameter l of the cylindrical contact section 75 of the receptacle 74 is set somewhat smaller than the diameter d of plug pin 78 so that plug pin 78 is inserted into receptacle 74. Upon the repetitive insertion and withdrawal of plug pin 78 into and out of receptacle 74, the cylindrical contact section 75 encounters an external expansion force, markedly reducing the function of holding plug pin 78. At that time, plug pin 78 is worn out during the mating engagement with receptacle 74.

SUMMARY OF THE INVENTION

It is accordingly the object of this invention to provide a connector device which neither undergoes any deformation of a receptacle under a repetitive insertion and withdrawal of a plug pin into and out of the receptacle, nor undergoes any wear due to the repetitive contact of the plug pin with the receptacle, whereby a high durability is obtained in spite of such a repetitive action.

According to this invention a connector device is provided which is comprised of a plug pin substantially rectangular in cross-section and a receptacle for receiving the plug pin in which the receptacle includes first and second end frames each having a substantially rectangular opening to permit the plug pin to be inserted into the receptacle, a support section extending from one side of the first end frame to a corresponding side of the second end frame and connecting the first end frame to the second end frame, whereby one side face of the plug pin is supported, and a pair of parallel elastic contact sections located opposite to the support section and adapted to be brought into engagement with an opposite face to the one face of the plug pin, and the plug pin is so formed as to have arcuate edges at its side face which is contacted by said pair of the elastic contact sections of the receptacle.

In the connector device so constructed, the rectangular receptacle is of such a type that the plug pin insertion opening is strengthened by the end frame of the rectangular configuration. It is, therefore, less liable to be deformed even if the plug pin is repeatedly inserted into, and withdrawn out of, the receptacle. Upon the insertion of the plug pin into the receptacle the plug pin is brought into proper contact with the receptacle under such a condition that the pair of elastic contact sections are outwardly swung aside on the corresponding arcuate side edges of the plug pin. As a result, the plug pin is placed in firm contact with the elastic contact sections of the receptacle without undue stress so that the receptacle is less liable to be locally worn out.

DETAILED DESCRIPTION OF THE INVENTION

A connector device according to one embodiment of this invention will now be explained below with reference to the accompanying drawings.

Figure 1:
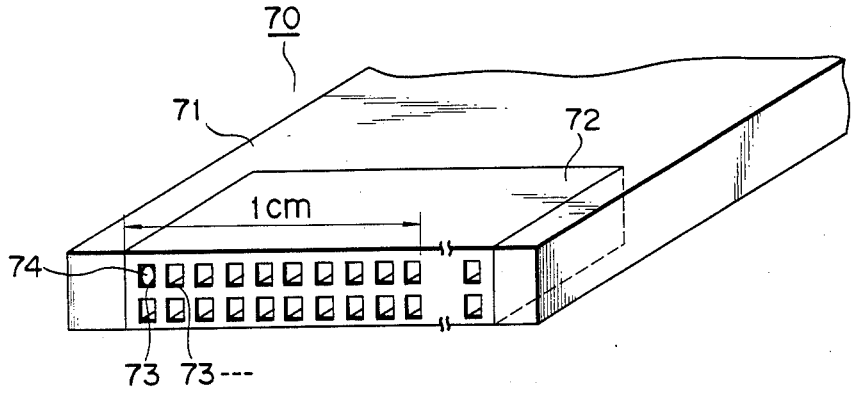
FIG. 1 (PRIOR ART)
FIG. 1 a view showing an outer appearance of an IC package.
Figure 2:
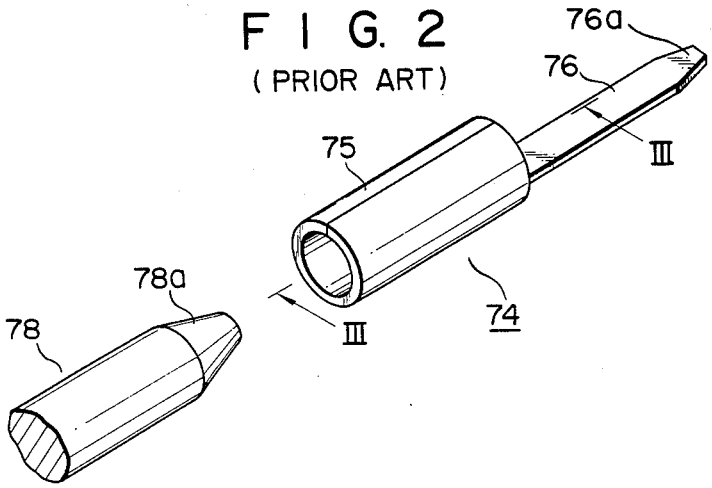
FIG. 2 (PRIOR ART)
FIG. 2 is a view showing a connector device with a plug pin removed from a receptacle.
Figure 3:
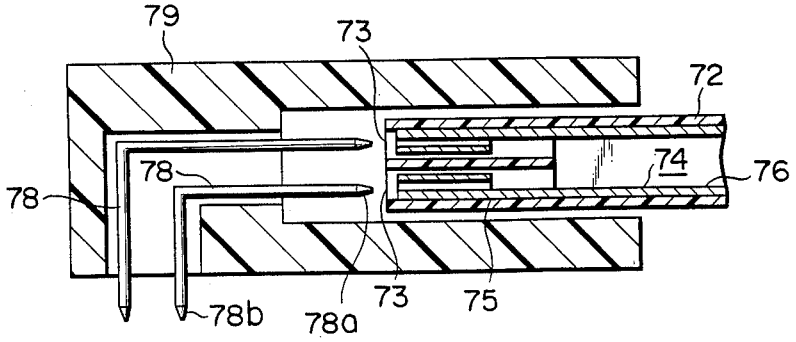
FIG. 3 (PRIOR ART)
FIG. 3 is a cross-sectional view taken along line III—III in FIG. 2.
Figure 4:
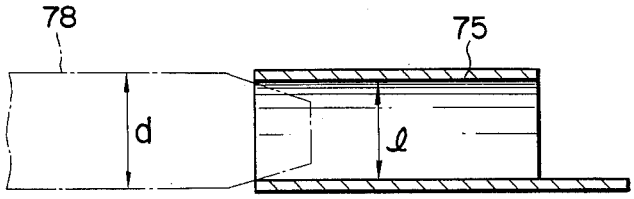
FIG. 4 (PRIOR ART)
FIG. 4 is a longitudinal, cross-sectional view as taken along line III—III in FIG. 2.
Figure 5:
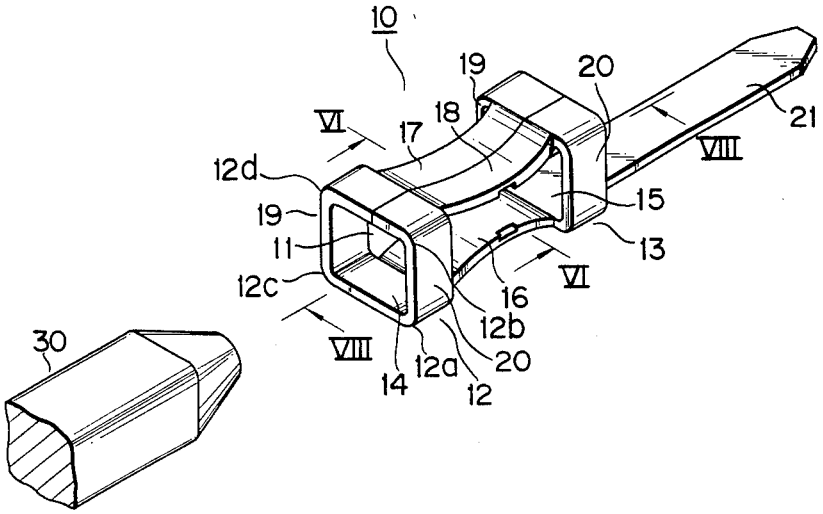
FIG. 5 is a view showing a connector device according to one embodiment of this invention with a plug pin removed from a receptacle.

FIG. 5 shows a connector device comprised of receptacle 10 and plug pin 30. As set forth above, receptacle 10 is attached to, for example, an IC package and plug pin 30 is attached to, for example, a printed circuit board. A semiconductor circuit of the IC package is connected to that of the aforementioned printed circuit board, if necessary.

Receptacle 10 is formed by basically bending a metal sheet into a substantially rectangular parallelepiped configuration. Plug pin insertion opening 11 of receptacle 10 is provided by first end frame 12 having a square opening. The first end frame is located opposite to second end frame 13 in a spaced-apart relation, noting that the second end frame is of a substantially the same configuration as the first end frame. Support section 16 is formed such that it is integral with base portion 14 of first end frame 12 and base portion 15 of second end frame 13. Elastic support section 16 extends such that it is curved toward the interior of receptacle 10 to provide an elastic contact section. First and second elastic sections 17 and 18 are formed opposite to support section 16 and extend in a parallel fashion such that they are connected to the upper side portions of first and second end frames 12 and 13. The receptacle is formed by perpendicularly bending connection portions 19 and 20 extending on both sides in the neighborhood of both the ends of support section 16.

Plug pin 30 is supported by elastic support section 16 and electrically contacted between support section 16 and first and second elastic contact sections to make a positive electrical connection with the receptacle.

Signal take-out pin 21 is formed integral with base portion 15 of second end frame 13 such that it extends remote from support section 16.

It may be considered that the plug pin may be formed of a substantially rectangular rod. However, there is a possibility that the plug pin will be worn out due to side edges 41 and 42 of the plug pin being in local contact with elastic contact sections 17 and 18. This is because elastic contact sections 17 and 18 are expanded in the vertical direction as well as in the lateral direction, i.e., are swung aside in the direction of a—a in FIGS. 6 and 7, when the plug pin is inserted into the receptacle.

Figure 6:
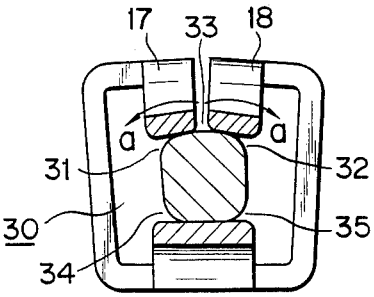
FIG. 6 is a cross-sectional view as taken along line VI—VI in FIG. 5.
Figure 7:
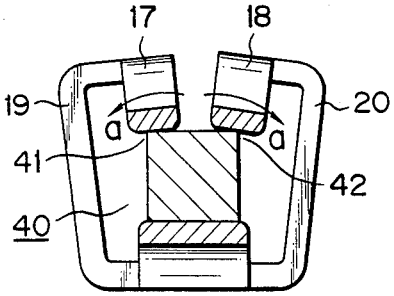
FIG. 7 is a cross-sectional view, similar to that of FIG. 6, and used to explain the first embodiment of this invention.
Figure 8:
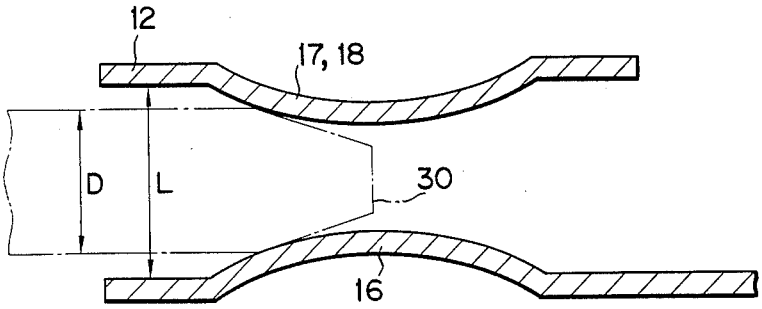
FIG. 8 is a cross-sectional view as taken along line VIII—VIII in FIG. 5.

As will be appreciated from FIG. 6, both the side edges of the plug pin which are in elastic contact with elastic contact sections 17 and 18 are rounded to provide arcuate side edges 31 and 32. That is, the plug pin is made substantially rectangular in cross-section, which corresponds to the rectangular configuration of receptacle 10, thus providing such arcuate side edges 31 and 32 on plug pin face 33. The curvatures of arcuate side edges 31 and 32 are properly determined in accordance with the configuration of the receptacle, but should be so selected that a better electrical connection may be obtained due to the swinging movement of elastic contact sections 17 and 18 in the direction of a—a in FIG. 6. Face 33 of plug pin 30 may be rounded not only at side edges 31 and 32 as set forth above, but also over its whole width. If, in this way, the aforementioned face of the plug pin is so formed as to be contacted at least by elastic contact sections 17 and 18 of the receptacle, there is no possibility that the side edges of the plug pin will be locally worn out. As a result, it is possible to obtain a better durability in spite of the repeated insertion and withdrawal of the plug pin into and out of the receptacle. As shown in FIG. 8, opening 11 of first end frame 12 of receptacle 10 has a diameter which is somewhat greater than the diameter D of plug pin 30 so that upon the insertion of plug pin 30 into the receptacle first end frame 12 is not deformed by the plug pin. Even if, upon the insertion of plug pin 30 into the receptacle, the plug pin is somewhat "mis-aligned" with opening 11 of the first end frame, the receptacle will not be directly deformed by the plug pin, since opening 11 of the first end frame is made in a greater dimension.

Even if such a misalignment occurs, elastic contact sections 17 and 18 are properly contacted by arcuate side edges 31 and 32 thus an elastic contact is made, in a stable fashion, with respect to the arcuate side edges.

First end frame 12 is formed by bending a metal sheet into a substantially rectangular configuration. For this reason, the mechanical strength of the first end frame is further increased by corners 12*a*, 12*b*, 12*c*, and 12*d* of the first end frame and, even if an outward expansion force is exerted on the first end frame, the first end frame is less likely to be distorted with the result that it is possible to provide a high resistance to deformation. Support section 16 and first and second elastic contact sections 17 and 18 provide a support structure that has no intermediate support member therein. As a result, support section 16 and contact sections 17 and 18 have such an adequate flexibility as to allow the plug pin to be supported in a stable fashion with a better, firm contact of the plug pin with first and second elastic contact sections of the receptacle.

A highly durable mating contact can be achieved by treating surface of the plug pin and receptacle, as follows. That is, a highly durable mating contact can be implemented by performing a surface treatment in a multi-layer fashion including, for example, a palladium alloy plating process or a harder noble-metal (for example, gold) plating process. Such a heat-treatment is very useful to an application where, in particular, a proper durability is required for the insertion and withdrawal of the plug pin into and out of the receptacle.

Figure 9:
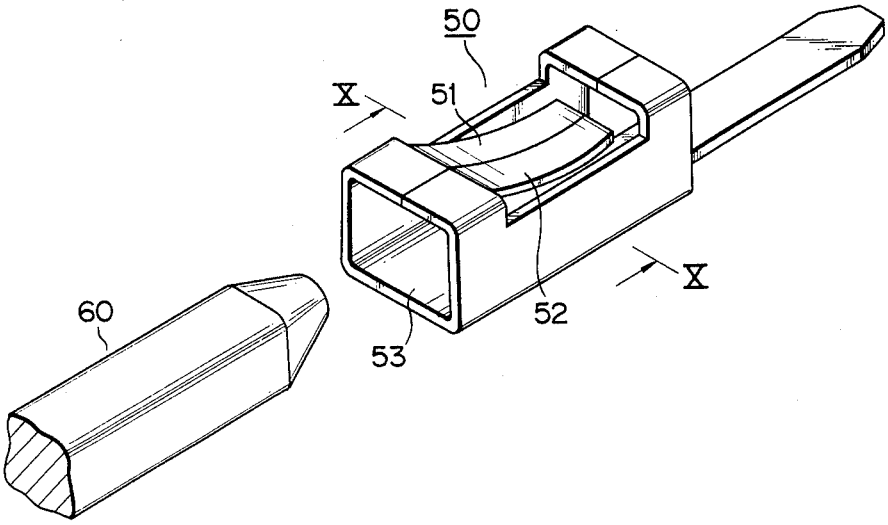
FIG. 9 is a view showing a connector device according to another embodiment of this invention.
Figure 10:
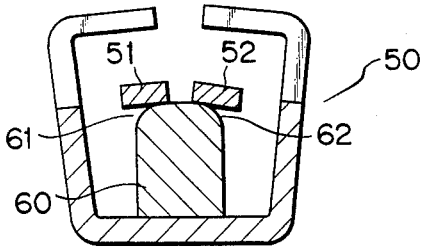
FIG. 10 is a cross-sectional view as taken along line X—X in FIG. 9.

FIG. 9 is a connector device according to another embodiment of this invention. In this embodiment, receptacle 50 is basically of a substantially rectangular parallelepiped type in which case two parallel, elastic contact sections 51 and 52 of receptacle 50 are of a cantilever spring type with supporting section 53 of no elasticity located opposite to the elastic contact sections. Even in this embodiment, upon the insertion into the receptacle of plug pin 60 having such arcuate side edges as set forth above in conjunction with the aforementioned embodiment, elastic contact sections 51 and 52 of the receptacle are brought into proper contact with arcuate side edges of plug pin 60 and there is no possibility that the side edges of plug pin 60 will be locally worn out.

What is claimed is:

1. An electrical terminal having a receptacle at one end for receiving an electrical pin, said receptacle having a substantially rectangular parallelepiped configuration and comprising:

first and second end frames spaced apart from one another, each end frame having a substantially rectangular opening and including a base member, two side members extending perpendicularly from each side of the base member, and a split top opposite said base member formed from two separate top members extending toward each other from each respective side member;

a base contact section extending between the base members of the first and second end frames; and first and second elastic top contact sections extending respectively between said first and second end frames opposite said base contact section, said first elastic top contact section extending between respective ones of said top members of the first and second end frames, said second elastic top contact section extending between respective others of said top members of the first and second end frames, both said first and second elastic top contact sections extending substantially parallel to one another and both top contact sections being curved inwardly toward the base contact section;

whereby when said pin is inserted into the receptacle, the engagement between said pin and the elastic base contact section and the first and second top contact sections will cause the side members of at least the first end frame to swing outward thus separating the first and second elastic top contact sections.

2. An electrical terminal according to claim 1, wherein said base contact section is curved inwardly toward the first and second elastic top contact section to provide an elastic base contact section.

3. An electrical terminal according to claim 1, wherein both ends of both the first and second elastic top contact sections are in contact with the respective top members of the first and second end frames.

4. An electrical terminal according to claim 1, wherein one end of each of the first and second elastic top contact members is free and the first and second elastic top contact members thereby act like cantilever springs.

5. An integrated circuit package comprising a body containing one or more integrated circuits and a connector attached to said body, said connector having a plurality of apertures formed in a grid-like array, a plurality of electrical terminals, each disposed within a corresponding aperture of said connector, one end of each electrical terminal is electrically connected to the integrated circuits within the body, the other end of each said electrical terminal having a receptacle for receiving an electrical pin, each said receptacle comprising:

first and second end frames spaced apart from one another, each end frame having a substantially rectangular opening and including a base member, two side members extending perpendicularly from each side of the base member, and a split top opposite said base member formed from two separate top members extending toward each other from each respective side member;

a base contact section extending between the base members of the first and second end frames; and first and second elastic top contact sections extending respectively between said first and second end frames opposite said base contact section, said first elastic top contact section extending between respective ones of said top members of the first and second end frames, said second elastic top contact section extending between respective others of said top members of the first and second end frames, both said first and second elastic contact sections extending substantially parallel to one another and both top contact sections being curved inwardly toward the base contact section;

whereby when said pin is inserted into the receptacle, the engagement between said pin and the elastic base contact section and the first and second top contact sections will cause the side members of at least the first end frame to swing outward thus separating the first and second elastic top contact sections.

6. An integrated circuit package according to claim 5 wherein said base contact section is curved inwardly toward the first and second elastic top contact sections to provide an elastic base contact section.

7. An integrated circuit package according to claim 5 wherein the ends of the first and second elastic top contact sections are formed integrally with the respective top members of the first and second end frames.

* * * * *